US007811018B2

(12) United States Patent
Yasumoto

(10) Patent No.: US 7,811,018 B2
(45) Date of Patent: Oct. 12, 2010

(54) DOOR OPENING OR CLOSING DETECTING APPARATUS AND IMAGE FORMING APPARATUS

(75) Inventor: Takeshi Yasumoto, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 834 days.

(21) Appl. No.: 11/741,879

(22) Filed: Apr. 30, 2007

(65) Prior Publication Data

US 2007/0283624 A1 Dec. 13, 2007

(30) Foreign Application Priority Data

May 15, 2006 (JP) ..... 2006-135894

(51) Int. Cl.
*B41J 29/13* (2006.01)
*G03G 21/00* (2006.01)

(52) U.S. Cl. ..... 400/692; 400/693; 399/124

(58) Field of Classification Search ..... 400/692, 400/693; 399/9, 124

See application file for complete search history.

(56) References Cited

U.S. PATENT DOCUMENTS 6,647,223 B2 * 11/2003 Ishii ..... 399/90

FOREIGN PATENT DOCUMENTS

JP 2003-200634 7/2003

* cited by examiner

*Primary Examiner*—Leslie J Evanisko
(74) *Attorney, Agent, or Firm*—Fitzpatrick, Cella, Harper & Scinto

(57) ABSTRACT

A door opening or closing detecting device and an image forming apparatus including a shaft member which is provided to a housing slidably along one end of a door, and urged to be brought into pressure contact with a pressing member through a pressure contact member, the shaft member being slid by the pressing member which moves with the opening/closing of the door. The opening/closing of the door is detected by a detecting portion according to sliding of the shaft member, and a power supply is interrupted by a switch portion. The door opening or closing detecting apparatus and the image forming apparatus are capable of reliably detecting the opening/closing of the door and appropriately interrupting the power supply while achieving space saving and reduction in size of the apparatus.

10 Claims, 7 Drawing Sheets

DOOR OPENING OR CLOSING DETECTING APPARATUS AND IMAGE FORMING APPARATUS

BACKGROUND OF THE INVENTION

Field of the Invention

The present invention relates to a door opening or closing detecting apparatus for detecting the opening/closing of a door and an image forming apparatus, and more particularly, to the arrangement of a door opening or closing detecting apparatus.

Up to now, some electronic devices or the like have, for example, opening portions for accessing the inside of an apparatus provided thereto as a unit for accessing the inside thereof. In this structure, a door rotationally supported by a hinge member is provided to generally cover an opening portion by the door.

For example, in an image forming apparatus typified by a printer, a copying machine, or a printing machine, which is an example of the electronic device, there may occur a necessity for accessing the inside of the apparatus in cases of a jam clearance operation, a maintenance operation, a replacement of consumables, and the like. In those cases, a user or a service person can easily perform removal of a jammed sheet, replacement of a cartridge, or the like by opening the door which is rotatably supported.

On the other hand, those doors are required to be tightly closed for the apparatus to operate normally. For example, in a case of the image forming apparatus, in a state where the doors are not tightly closed, a malfunction or breakage of components may be caused by erroneously touching a unit, an operation portion, or the like that is mounted so as to be inserted/removed.

As a result, in the conventional image forming apparatus, a door opening or closing detecting apparatus for detecting the opening/closing of a door is provided to determine whether the door is tightly closed based on a signal from the door opening or closing detecting apparatus, that is, whether the apparatus can normally operate. Then, when it is determined that the door is tightly closed, the image forming apparatus can perform an image forming operation.

Examples of the door opening or closing detecting apparatus include one for detecting the opening/closing of a door using a shielding type sensor typified by a photo interrupter. In a detection method using such a sensor, there is generally provided a detecting portion at a position apart from a hinge portion, for example, on a side portion or an upper portion of the door so that a large displacement amount of a shielding flag with respect to a rotation amount of the door can be obtained in order to enhance detection accuracy.

However, when the detecting portion is provided on the side portion or the upper portion of the door, it is necessary to ensure a space for installation of the detecting portion. Accordingly, the apparatus increases in size. In the image forming apparatus, in a case where there are such restrictions that other transport paths and the like are provided on the side portion or the upper portion of the door, it is difficult to install the door opening or closing detecting apparatus.

To the contrary, a space in the vicinity of the hinge portion of the door is relatively advantageous as an installation space in that, for example, there are extremely few such restrictions that other transport paths present, and a retraction space of the opening/closing door itself is originally provided as dead space. Accordingly, there is an example where the door opening or closing detecting apparatus is provided to the hinge portion of the door by focusing on the above-mentioned advantages.

By providing, for example, a door opening or closing detecting apparatus using a switch type sensor as a detection unit to the position, a problem with the displacement amount can be solved, and the space for the door opening or closing detecting apparatus can be saved. Japanese Patent Application Laid-Open No. 2003-200634 discloses the above-mentioned technique.

However, in the conventional door opening or closing detecting apparatus, in the case where the door opening or closing detecting apparatus is provided in the vicinity of the hinge portion of the door, it is extremely disadvantageous in ensuring a moving stroke of a pressing member for turning on/off the switch type sensor. Similarly, in a case where the photo interrupter is used, it is extremely disadvantageous in ensuring the moving stroke of the shielding flag for shielding the photo interrupter.

In the case where the moving stroke of the pressing member or the like cannot be ensured, there arises a problem in that a detection failure or the like is liable to occur when a detected portion provided to the door is detected by the detecting portion provided on the apparatus main body side.

On the other hand, in order to reliably prevent a malfunction, breakage of components, or the like which may occur when the door is opened as described above, it is necessary not only to report information on the opening/closing of the door, but also to interrupt a power supply itself to a drive portion or the like when the door is opened.

In this case, when the power supply is instantaneously interrupted after the opening of the door is detected, there is a fear that, for example, a motor driver which controls the flow of constant current through a drive motor may provide the rapid flow of current, which leads to breakage or the like of the motor driver or the drive motor.

For this reason, it is necessary to set a time lag such that, for example, when the door is opened, the opening of the door is first detected, and then a switch for providing/interrupting the power supply is turned off. In order to set the time lag, a mechanism therefor is complicated, and it is necessary to cause the detected portion to generate a large displacement amount. In the above-mentioned structure of Japanese Patent Application Laid-Open No. 2003-200634, a moving stroke of the detected portion which is necessary for providing the time lag cannot be obtained.

SUMMARY OF THE INVENTION

The present invention has been made in view of the above-mentioned circumstances, and therefore, an object of the present invention is to provide a door opening or closing detecting apparatus and an image forming apparatus that are capable of reliably detecting the opening/closing of a door while achieving space saving and reduction in size of the apparatus.

According to the present invention, there is provided a door opening or closing detecting apparatus for detecting the opening or closing of a door rotationally supported by a housing, the apparatus including:

a conversion mechanism which converts a rotation of the door into a sliding of a shaft member along a rotation axis of the door; and a detecting portion which detects the opening or closing of the door, wherein the detecting portion detects the opening or closing of the door according to sliding of the shaft member by the conversion mechanism in association with the opening or closing of the door.

Further features of the present invention will become apparent from the following description of exemplary embodiments with reference to the attached drawings.

DESCRIPTION OF THE EMBODIMENTS

Hereinafter, an exemplary embodiment for carrying out the present invention will be described in detail with reference to the drawings.

In an embodiment of the present invention, as a specific example of an apparatus including a door, an image forming apparatus typified by a printer, a copying machine, a printing machine, or the like is described. It should be noted that the image forming apparatus is one of a tandem intermediate transfer type having image forming portions for four colors arranged on an intermediate transfer belt.

Figure 1:
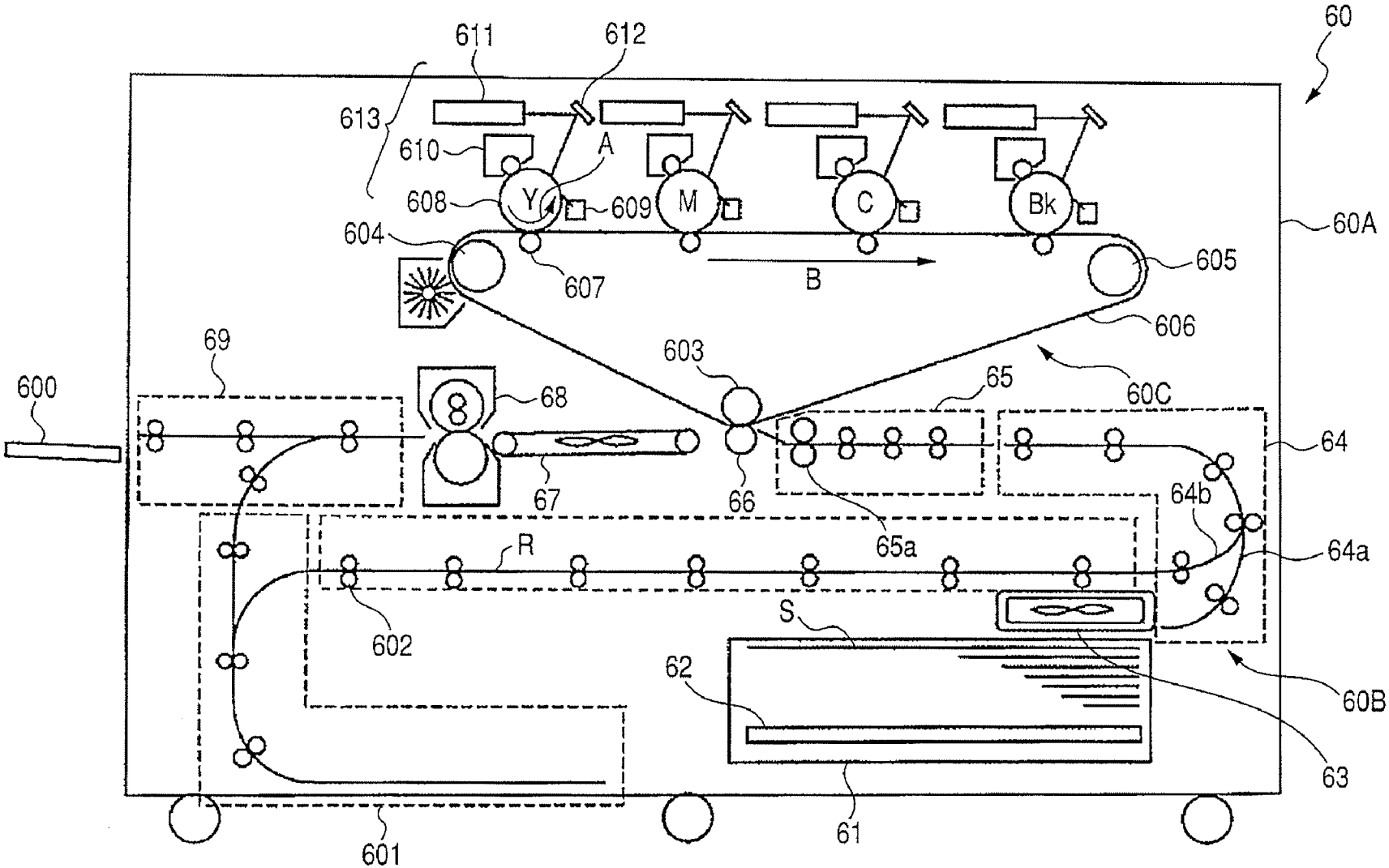
FIG. 1 is a diagram for illustrating a schematic structure of a color image forming apparatus which is an example of an image forming apparatus including a door opening or closing detecting apparatus according to an embodiment of the present invention.

FIG. 1 is a diagram for illustrating a schematic structure of a color image forming apparatus which is an example of an image forming apparatus including a door opening or closing detecting apparatus according to the embodiment of the present invention.

In FIG. 1, a color image forming apparatus main body (hereinafter referred to as "apparatus main body") 60A of a color image forming apparatus 60 includes an image forming portion 613, a sheet feed portion 60B for feeding a sheet S, and a transfer portion 60C for transferring a toner image formed in the image forming portion 613 onto the sheet S fed by the sheet feed portion 60B.

In this case, the image forming portion 613 includes image forming units for yellow (Y), magenta (M), cyan (C), and black (B) each including a photosensitive member 608, an exposure device 611, a developing device 610, a primary transfer device 607, and a photosensitive member cleaner 609. In other words, the color image forming apparatus 60 according to this embodiment is one of a tandem intermediate transfer type having the image forming units for four colors serving as image forming portions arranged on an intermediate transfer belt described later. It should be noted that colors to be formed by the respective image forming units are not limited to those four colors, and the arrangement of the colors is not limited thereto.

Further, the sheet feed portion 60B includes a sheet feed cassette 61 serving as a sheet containing portion which contains the sheets S so as to be stacked on a lift-up device 62 and is capable of drawing out the sheets S, and a sheet feed unit 63 for feeding the sheet S contained in the sheet feed cassette 61. In this case, as the sheet feed unit 63, a method using frictional separation by sheet feed rollers or the like, a method using separation suction by air, or the like is employed. In this embodiment, a sheet feed method by air is used as an example.

Further, the transfer portion 60C is suspended under tension over rollers such as a drive roller 604, a tension roller 605, and a secondary transfer inner roller 603, and includes an intermediate transfer belt 606 which is transported and driven in a direction indicated by an arrow B of FIG. 1.

In this case, onto the intermediate transfer belt 606, a toner image formed on a photosensitive member is transferred by application of a predetermined pressure force and electrostatic load bias given by the primary transfer device 607. By application of the predetermined pressure force and electrostatic load bias in a secondary transfer portion including the secondary transfer inner roller 603 and a secondary transfer outer roller 66 that are substantially opposed to each other, an unfixed toner image is absorbed into the sheet S.

Then, in forming an image with the color image forming apparatus 60 having the above-mentioned structure, surfaces of the photosensitive members 608 are first uniformly charged in advance by a charging unit (not shown). After that, the exposure devices 611 emit light on the basis of a sent image information signal, with respect to the photosensitive members 608 rotating in a direction indicated by an arrow A of FIG. 1. Then, the light is irradiated by appropriately passing through a reflection unit 612 and the like, thereby forming a latent image on each surface of the photosensitive members. It should be noted that a small amount of un-transferred residual toner on the photosensitive members 608 is collected by the photosensitive member cleaners 609 so as to be prepared for the subsequent image formation.

Next, the electrostatic latent image thus formed on each of the photosensitive members 608 is subjected to toner development by the developing devices 610, thereby forming a toner image on each of the photosensitive members. After that, the toner image is applied with the predetermined pressure force and electrostatic load bias by the primary transfer devices 607, thereby transferring the toner image onto the intermediate transfer belt 606.

It should be noted that the image formation by the image forming units for Y, M, C, and Bk of the image forming portion 613 is performed at a timing when a toner image is superimposed on the toner image obtained through the primary transfer on an upstream side on the intermediate transfer belt. As a result, a full toner color image is formed at last on the intermediate transfer belt 606.

Further, the sheet S is fed from the sheet feed cassette 61 by the sheet feed unit 63 at an image formation timing of the image forming portion 613. After that, the sheet S is transported to a registration unit 65 passing through a transport path 64*a*. After the sheet S is subjected to skew correction or timing correction by a registration roller 65*a* in the registration unit 65, the sheet S is transported to the secondary transfer portion including the secondary transfer inner roller 603 and the secondary transfer outer roller 66 that are substantially opposed to each other. After that, by application of the predetermined pressure force and electrostatic load bias in the secondary transfer portion, the full color toner image is secondarily transferred onto the sheet S.

Next, the sheet S having the toner image thus secondarily transferred thereto is transported to a fixing device 68 by a pre-fixing transport portion 67. Then, in the fixing device 68, by application of the predetermined pressure force by substantially opposing rollers, a belt, or the like, or generally by application of a heating effect by a heat source of a heater or the like, the toner is fused and fixed onto the sheet S.

Then, the sheet S having the fixed image thus obtained is directly delivered by a branch transport device 69 onto a delivery tray 600. In a case where an image is formed on both sides of the sheet S, switching of a switch flapper (not shown) is performed, and then the sheet S is transported to a reverse transport device 601.

In this case, when the sheet S is thus transported to the reverse transport device 601, a leading edge and a trailing edge of the sheet S are reversed through a switch-back operation, and the sheet S is transported to a re-transport path R provided to a duplex transport device 602. After that, at a timing when a sheet of a subsequent job is to be transported from the sheet feed portion 60B, the sheet S is merged into a re-feed path 64*b* included in the sheet transport device 64 and is fed to the secondary transfer portion in the same manner as described above. The subsequent image forming process is similar to that of a first side of the sheet, so a description thereof will be omitted.

The color image forming apparatus 60 having the above-mentioned structure has the necessity of accessing the internal necessary portion of the apparatus from outside of the apparatus in the case of performing a sheet removing operation when sheet jamming occurs, replenishment/replacement of consumables, or a maintenance/check operation. Accordingly, by providing a door to the apparatus main body 60A that can be opened and closed, working properties thereof can be improved.

Figure 2:
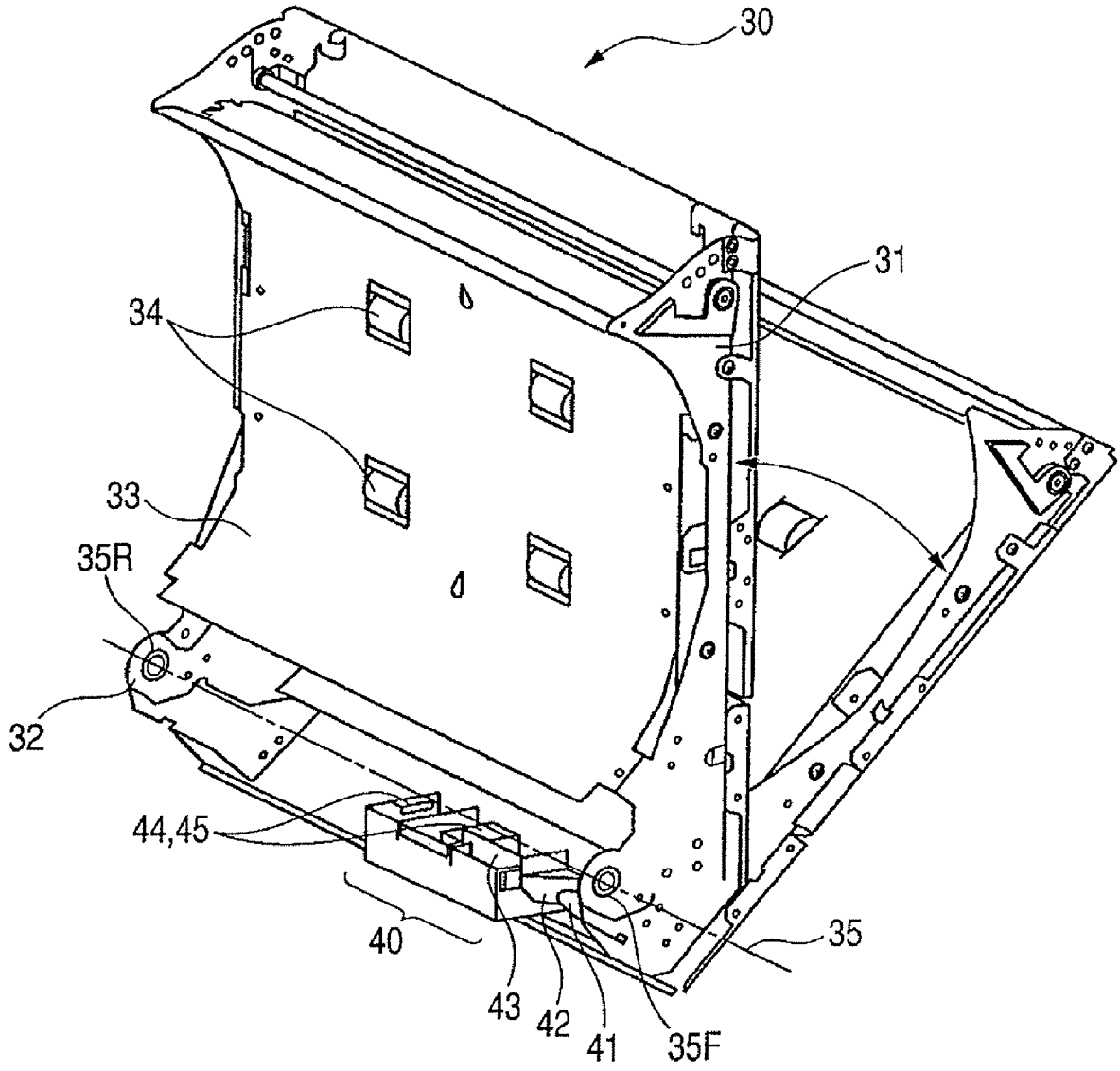
FIG. 2 is a perspective view for illustrating a positional relationship between the door opening or closing detecting apparatus and a door.

For example, FIG. 2 illustrates a door 30 which is to be opened in a case where sheet jamming occurs in the transport path 64*a* illustrated in FIG. 1. It should be noted that the transport path is generally formed by two opposing guide plates. In the door 30 illustrated in FIG. 2, an external guide plate 33 forming the transport path 64*a* is fixed to the inside of the door 30.

The door 30 includes a front-side plate 31 and a rear-side plate 32 that are opposed to each other and fix the guide plate 33, and roller members 34 for nipping and transporting a sheet, in addition to the guide plate 33. The front-side plate 31 and the rear-side plate 32 each have a substantially L-shape with a protruding lower end portion (one end portion), and has shaft support portions 35F and 35R being pivotally supported by a hinge portion (not shown) on a short-side portion side of the L-shape (on side of the L-shape to be fitted into apparatus main body 60A). Then, the door 30 is supported so as to be opened/closed with respect to the apparatus main body 60A, which is a housing, as indicated by the arrow of FIG. 2, with an axis 35, which is indicated by an alternate long and short dash line of FIG. 2 and passes through the center of the shaft support portions 35F and 35R, as a fulcrum (rotation center).

In this case, with the above-mentioned structure, when the door 30 is opened, the door 30 is opened such that a part thereof is fitted into the apparatus main body. When the door 30 is thus opened, especially in a case where the door 30 is provided for the purpose of jam clearance, a large opening amount can be obtained even with a small protruding amount of the opened door, which is advantageous in an installation space and a working property for jam clearance.

Further, in FIG. 2, a door opening or closing detecting apparatus 40 for detecting opening/closing of the door 30 is provided in a space between the short-side portions of the substantially L-shapes of front-side plate 31 and the rear-side plate 32. In this case, the space between the short-side portions of the substantially L-shapes is a retraction space provided in the vicinity of the hinge portion of the door 30. By installation of the door opening or closing detecting apparatus 40 to the retraction space which is dead space, it is possible to improve space efficiency.

The door opening or closing detecting apparatus 40 includes a pressing member 41 mounted on an inner side of the short-side portion of the L-shape of the front-side plate 31. When the door 30 is opened or closed, the pressing member 41 rotates in a vertical direction with the axis 35 of the shaft support portions 35F and 35R as a center.

Figure 3:
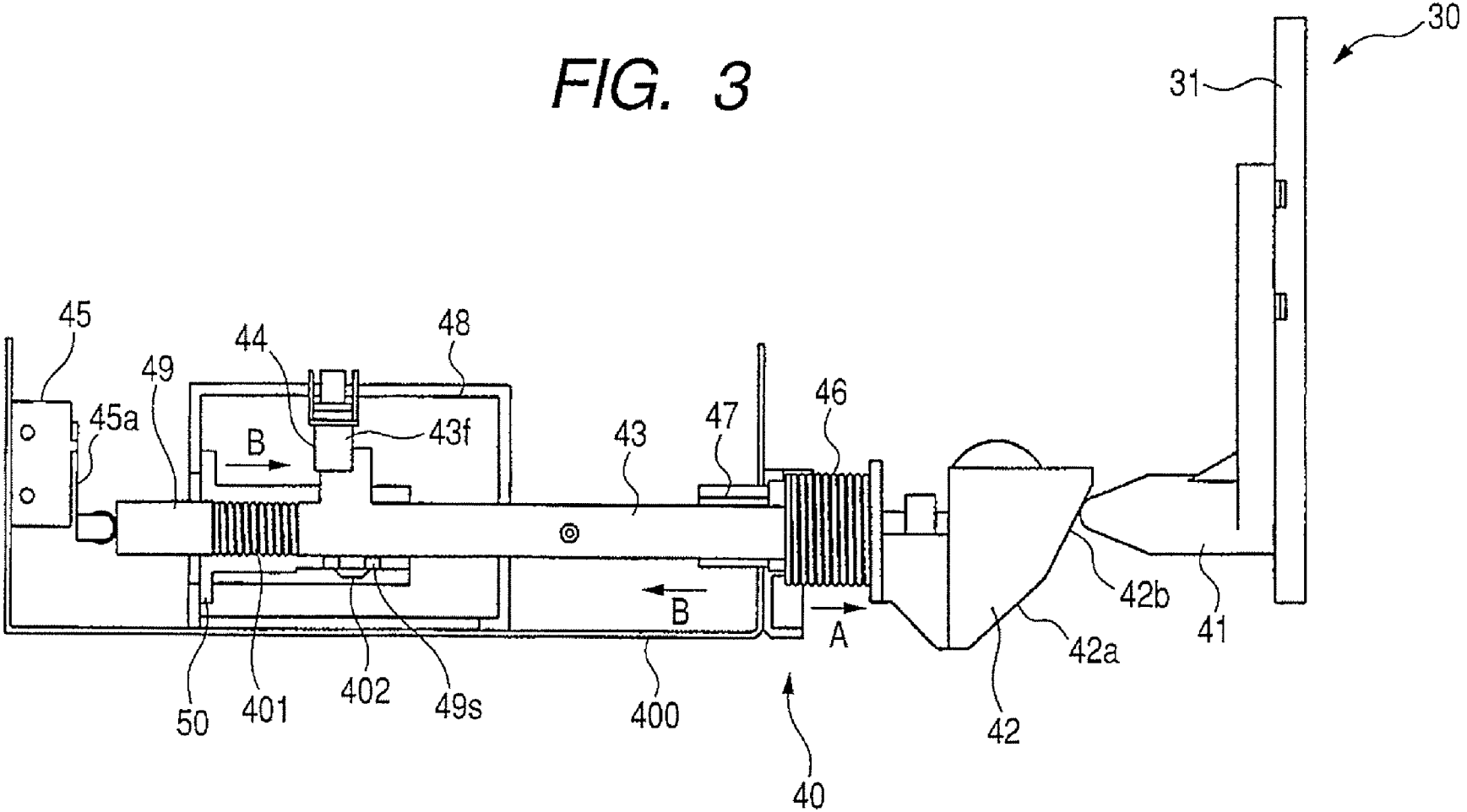
FIG. 3 is a diagram for illustrating a structure of the door opening or closing detecting apparatus.

As illustrated in FIG. 3, the door opening or closing detecting apparatus 40 includes a switch shaft 43 which is slidably supported by bearing members 47 and 48 fixed to a frame member 400 mounted on the apparatus main body 60A, in parallel with the axis 35 of the shaft support portions 35F and 35R. Further, the door opening or closing detecting apparatus 40 includes a micro switch 45 mounted to the frame member 400, and a photo interrupter 44 mounted to the bearing member 48.

In this case, on one end of the switch shaft 43 serving as a shaft member, a pressure contact member 42 including two tapered surfaces 42*a* and 42*b* having different gradients is integrally mounted, and the pressing member 41 mounted to the front-side plate 31 is brought into pressure contact with the pressure contact member 42. As mentioned below, when the pressing member 41 rotates with the opening/closing of the door 30, the pressing member 41 rotates while being brought into pressure contact with the two tapered surfaces 42*a* and 42*b* of the pressure contact member 42 constituting a pressure contact portion.

In this case, a conversion mechanism in the present invention converts a rotation of the door 30 into a sliding of the switch shaft 43 along the axis 35, and the conversion mechanism comprises the pressing member 41 and the pressure contact member 42. As mentioned below, the photo interrupter 44 detects the opening or closing of the door 30 according to sliding of the switch shaft 43 by the conversion mechanism in association with the opening or closing of the door 30.

Further, a returning spring 46 is provided between the pressure contact member 42 and the bearing member 47. The entire switch shaft including a switch pressing member 49 described later is urged by the returning spring 46 in a direction indicated by the arrow A of FIG. 3, and the pressure contact member 42 is brought into pressure contact with the pressing member 41.

It should be noted that a flag portion 43*f* is provided to the switch shaft 43. When the switch shaft 43 moves in a direction indicated by the arrow B, the flag portion 43*f* interrupts light from the photo interrupter 44 serving as a detecting portion for detecting opening/closing of the door 30, and thus the photo interrupter 44 is turned on.

Then, when the photo interrupter 44 is thus turned on, a control device (not shown) determines that the door 30 is closed. To the contrary, when the interruption of the light from the photo interrupter 44 by the flag portion 43*f* is released and thus the photo interrupter 44 is turned off, the control device determines that the door 30 is opened.

On the other hand, on the other end of the switch shaft 43, the switch pressing member 49 serving as a switch depressing member is slidably mounted to the switch shaft 43 through a stepped screw 402 inserted into a slit 49*s*. Further, a spring 401 for generating a time lag is provided between the switch shaft 43 and the switch pressing member 49. The switch shaft 43 and the switch pressing member 49 each receive an urging force by the spring 401 for generating a time lag in the direction in which the switch shaft 43 and the switch pressing member 49 are departing from each other.

In this case, a switch lever 45*a* of the micro switch 45 serving as a switch portion for interrupting a power supply is provided lateral to the switch pressing member 49. When the switch shaft 43 moves in a direction indicated by the arrow B, the switch pressing member 49 presses the switch lever 45*a* to turn on the micro switch 45. Then, when the micro switch 45 is thus turned on in association with the opening of the door 30, the control device interrupts the power supply, for example, to a drive portion or the like of the transport rollers.

In FIG. 3, when the switch shaft 43 is pressed back in a direction of the arrow B as mentioned below, a flange 50 provided to the switch pressing member 49 is abutted against the bearing member 48, and thus, the switch pressing member 49 is stopped. Even when the switch pressing member 49 is thus stopped, the switch shaft 43 can move in a direction of the arrow B while compressing the spring 401 for generating a time lag.

In other words, in this embodiment, the photo interrupter 44 and the micro switch 45 are sequentially turned on/off in association with the movement of the switch shaft 43. Then, the control device makes a determination as to the opening/closing of the door 30 according to the turning on/off of the photo interrupter 44 and controls the power supply to the drive portion or the like according to the turning on/off of the micro switch 45.

Figure 4:
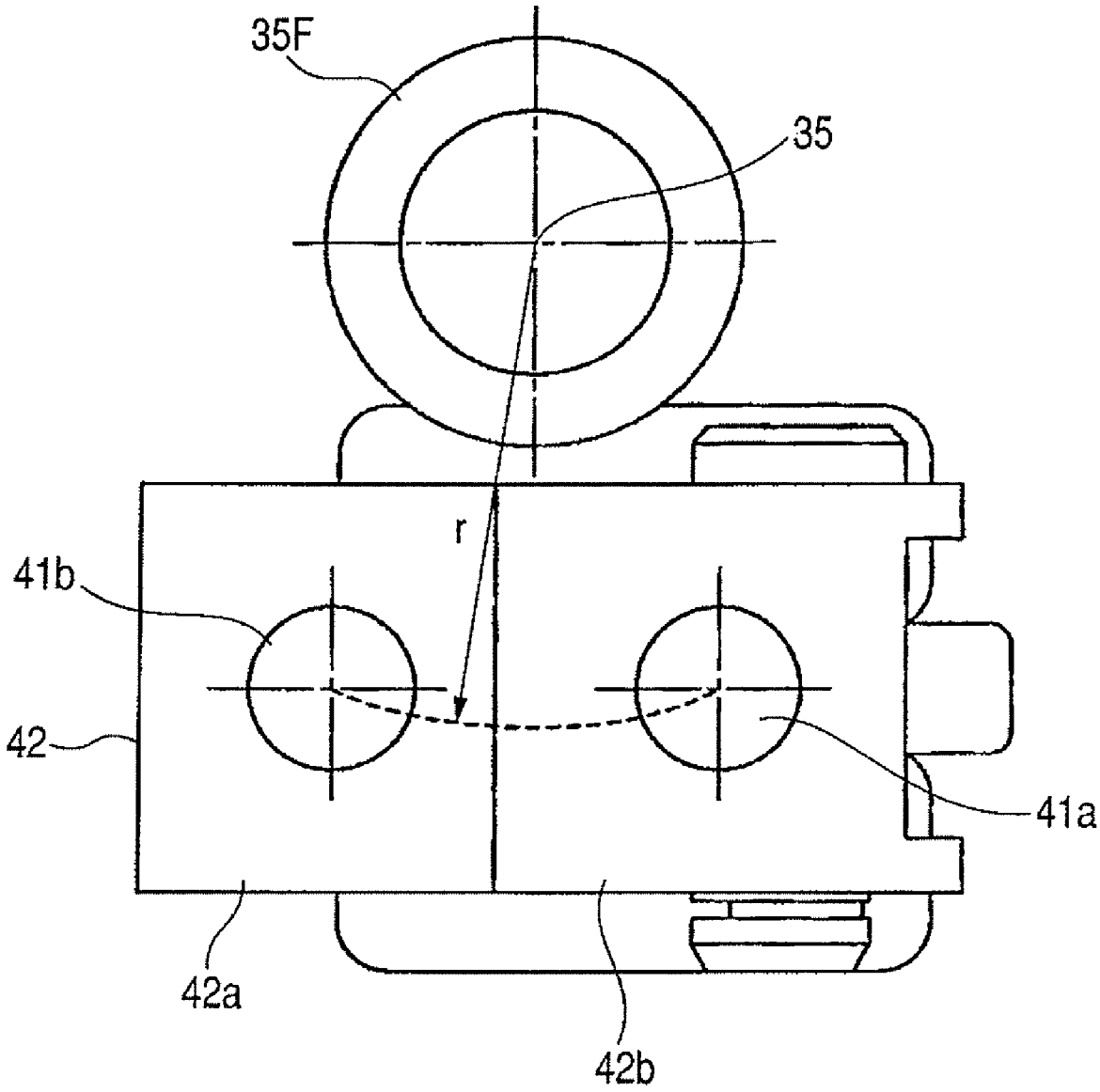
FIG. 4 is a diagram for illustrating a movement locus of a pressing member provided to the door opening or closing detecting apparatus, in association with the opening/closing of a door.
Figure 5:
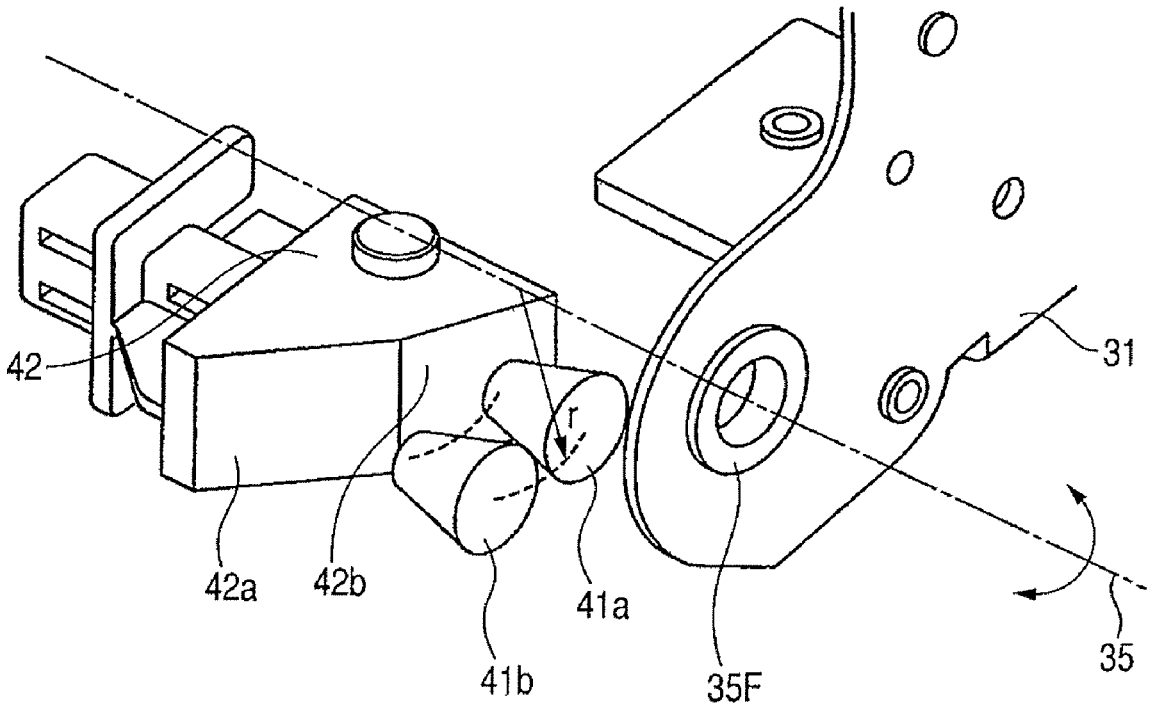
FIG. 5 is a diagram for illustrating the movement locus of the pressing member provided to the door opening or closing detecting apparatus in association with the opening/closing of the door.

The pressure contact member 42 brought into contact with the pressing member 41 includes the first tapered surface 42*a* and the second tapered surface 42*b*, which are brought into contact with the pressing member 41, as described above. As illustrated in FIG. 4, the pressing member 41 is provided at a position apart from the axis 35 by a radius r, and the pressing member 41 rotates (moves) while drawing a locus as indicated by a broken line of FIG. 4. It should be noted that FIGS. 4 and 5 each illustrate a position 41*a* of the pressing member 41 in a case where the door 30 is closed, and a position 41*b* of the pressing member 41 in a case where the door 30 is opened.

When the pressing member 41 thus moves in association with the opening/closing of the door 30, the pressing member 41 moves while being brought into pressure contact with the tapered surfaces 42*a* and 42*b* of the pressure contact member 42. When the pressing member 41 thus moves, a force for sliding the switch shaft 43 in an axial direction, that is, along one end of the door 30, which is rotationally supported by a hinge portion (not shown), is generated in the switch shaft 43.

As described above, in this embodiment, when the pressing member 41 rotates in association with the opening/closing operation of the door 30, the switch shaft 43 slidingly moves through rotation of the pressing member 41. Then, when the switch shaft 43 thus slidingly moves, the photo interrupter 44 and the micro switch 45 are turned on/off.

Figure 6A:
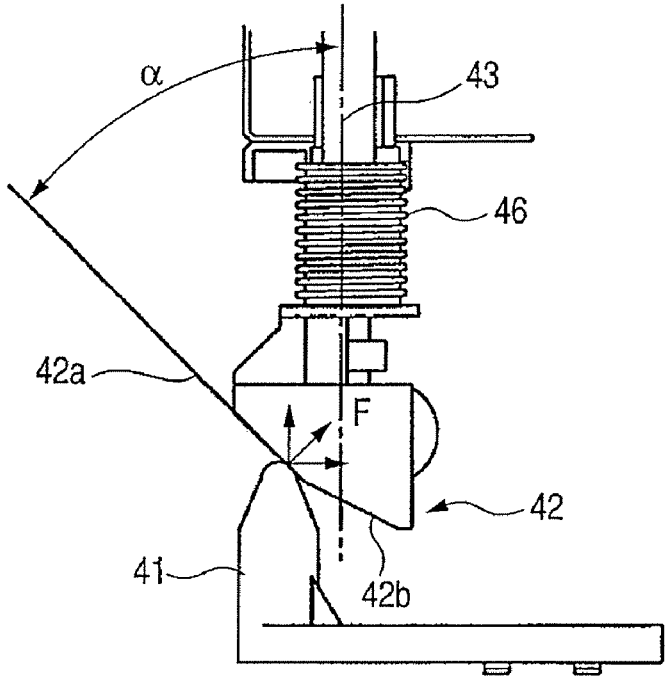
FIGS. 6A and 6B are diagrams for illustrating operations of a switch shaft provided to the door opening or closing detecting apparatus, in association with the opening/closing of the door.
Figure 6B:
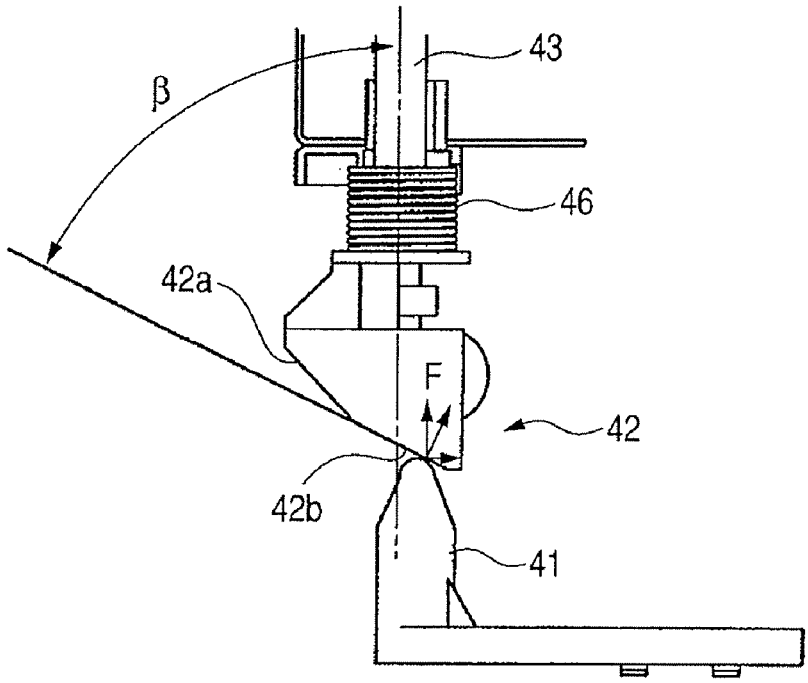

The first tapered surface 42*a* of the pressure contact member 42 has a gradient of an angle $\alpha$ with respect to the axis of the switch shaft 43 that is a sliding direction of the switch shaft 43 as illustrated in FIG. 6A. The second tapered surface 42*b* has a gradient of an angle $\beta$ as illustrated in FIG. 6B. When the door 30 is opened, the pressing member 41 is brought into pressure contact with the first tapered surface 42*a* as illustrated in FIG. 6A. Further, when the door 30 is closed, the pressing member 41 is brought into pressure contact with the second tapered surface 42*b* as illustrated in FIG. 6B.

In this case, in this embodiment, in the state where the door 30 is opened, an amount of compression of the returning spring 46 is set to a minimum as illustrated in FIG. 6A. As a result, a force required for sliding the switch shaft 43 becomes small. To the contrary, in the state where the door 30 is closed, the amount of compression of the returning spring 46 is maximized. As a result, a large force for sliding the switch shaft 43 is required.

On the other hand, in FIGS. 6A and 6B, assuming that a force received by the pressure contact member 42 from the pressing member 41 in association with the opening/closing of the door 30 is set as F, in the switch shaft 43, a sliding direction component $F\sin\alpha$ is added to the first tapered surface 42*a* when the door 30 is opened, and a sliding direction component $F\sin\beta$ is added to the second tapered surface 42*b* when the door 30 is closed, respectively.

In this embodiment, the gradients $\alpha$ and $\beta$ are set to satisfy $\alpha<\beta<90°$ so that the sliding direction component becomes larger in proportion to the magnitude of the necessary sliding force. Specifically, the gradient of each of the tapered surfaces 42*a* and 42*b* of the pressure contact member 42 increases toward 90° from the opened state to the closed state of the door 30. As a result, the sliding direction component $F\sin\beta$ added to the switch shaft 43 when the door 30 is closed can be made larger than the sliding direction component $F\sin\alpha$ added to the switch shaft 43 when the door 30 is opened. Accordingly, the switch shaft 43 can be reliably slid when the door 30 is closed.

Further, when the gradients $\alpha$ and $\beta$ are set to satisfy $\alpha<\beta<90°$, the sliding moving amount of the switch shaft 43 obtained when the switch shaft 43 shifts from a state of FIG. 6A to a state of FIG. 6B can be set to be larger than a case where, for example, $\alpha=\beta$ is satisfied.

In other words, in this embodiment, in the state where the door 30 is closed, by adding a large sliding direction component by the switch shaft 43, it is possible to prevent a malfunction from occurring without sliding the switch shaft 43 due to vibrations or the like. On the other hand, in the state where the door 30 is opened, the photo interrupter 44 and the micro switch 45 can be reliably turned on/off by setting a time lag so that a larger sliding direction displacement can be obtained in the state where the door 30 is opened.

Thus, in the state where the door 30 is opened, by obtaining a larger sliding direction displacement, sufficient detection accuracy can be obtained even when the door opening or closing detecting apparatus 40 is provided in the vicinity of the hinge portion. It should be noted that the pressing member 41 has a tip end in a hemispherical shape formed of a curved surface, and thus the pressing member 41 can smoothly rotate irrespective of being brought into pressure contact with the first tapered surface 42*a* or the second tapered surface 42*b*, which is inclined at an angle different from that of the first tapered surface 42*a*.

Figure 7A:
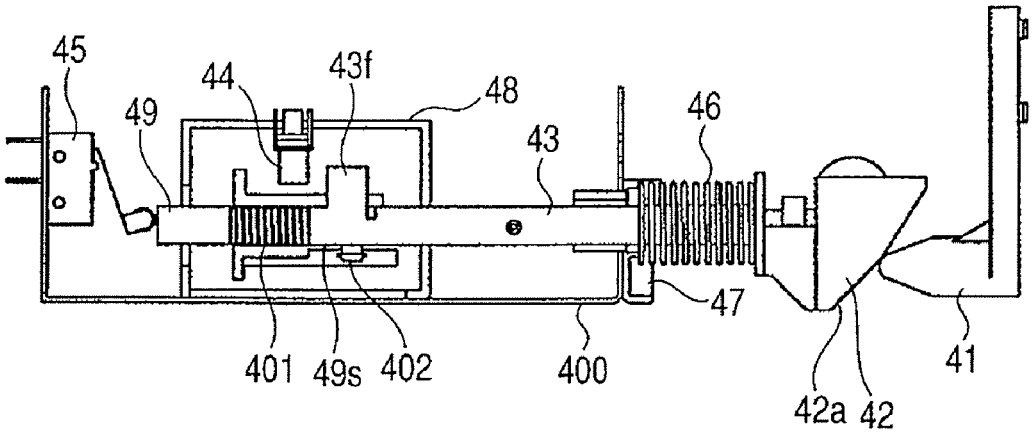
FIGS. 7A, 7B, and 7C are diagrams for illustrating a door opening/closing detecting operation of the door opening or closing detecting apparatus.
Figure 7B:
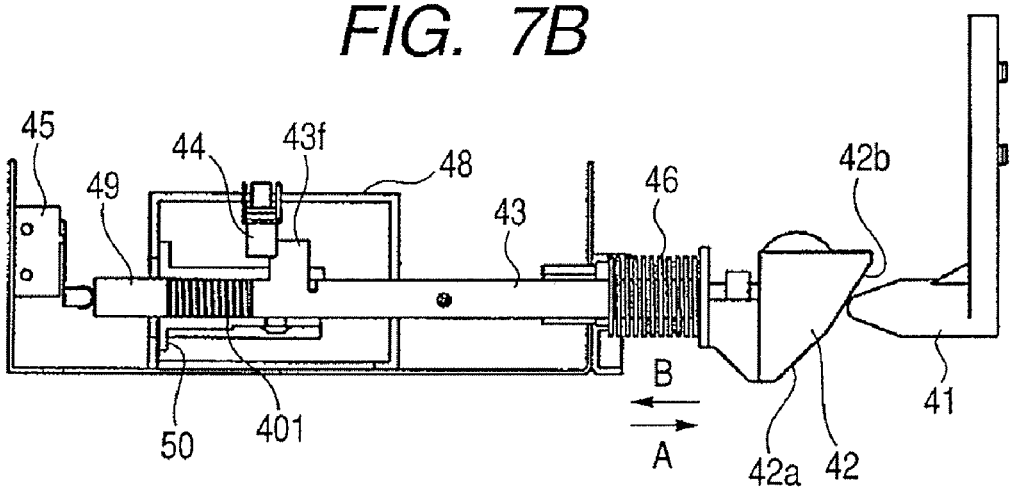
Figure 7C:
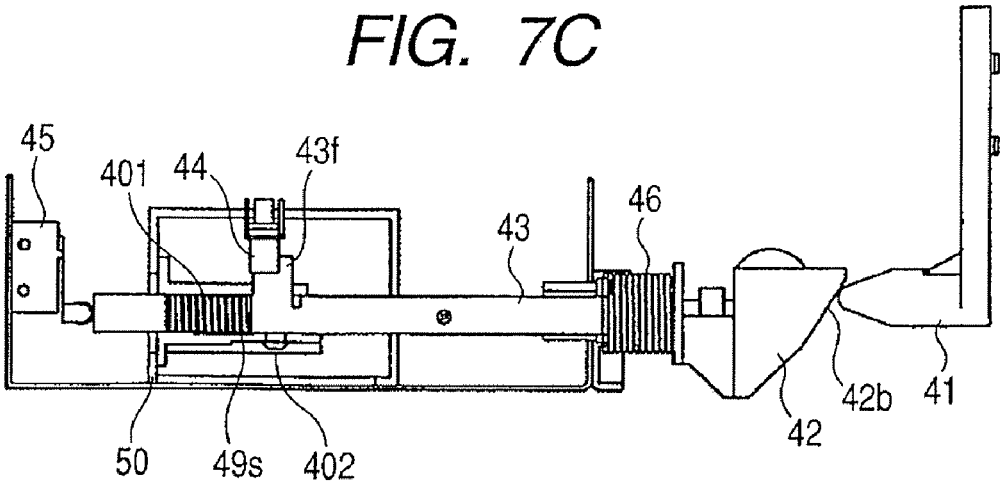

Next, the opening/closing detecting operation of the door 30 of the door opening or closing detecting apparatus 40 will be described with reference to FIGS. 7A, 7B, and 7C. FIG. 7A illustrates a state where the door 30 is opened, FIG. 7B illustrates a state where the door 30 is being closed, and FIG. 7C illustrates a state where the door 30 is closed, respectively.

In the state where the door 30 is closed, the pressing member 41 is brought into contact with the first tapered surface 42*a* of the pressure contact member 42 as illustrated in FIG. 7A. The switch pressing member 49 extends while the stepped screw 402 is brought into contact with the slit 49*s* by an urging force of the spring force 401 for generating a time lag.

It should be noted that, when the switch shaft 43 moves to the position illustrated in FIG. 7A, the flag portion 43*f* does not interrupt the light from the photo interrupter 44, and the switch pressing member 49 does not press the switch lever 45*a*. Accordingly, the photo interrupter 44 and the micro switch 45 are in the off state.

Then, when the photo interrupter 44 and the micro switch 45 are in the off state as described above, the control device causes, for example, a display screen (not shown) of an operation unit or the like to display opening of the door 30 and interrupts the power supply to the drive unit or the like. As a result, a user can perform jam clearance or the like, and it is possible to prevent, in advance, members or the like of a drive system from being erroneously damaged.

Next, when the door 30 is being closed, the pressing member 41 moves toward the second tapered surface 42*b* while being brought into pressure contact with the first tapered surface 42*a*. With the movement of the pressing member 41, the switch shaft 43 is pressed back in a direction of the arrow B against the returning spring 46 as illustrated in FIG. 7B.

In this case, the flag portion 43*f* is not interrupting the light from the photo interrupter 44. However, the switch pressing member 49 presses the switch lever 45*a*, and thus, the micro switch 45 is turned on. It should be noted that the switch pressing member 49 is remained in the extended state while the stepped screw 402 is brought into contact with the slit 49*s* by the urging force of the spring 401 for generating a time lag.

As described above, when the micro switch 45 is in the on state and the photo interrupter 44 is in the off state, the control device causes, for example, the display screen (not shown) of the operation portion or the like to display opening of the door 30 and resumes only supplying power to the drive portion or the like.

Further, when the door 30 is being closed as illustrated in FIG. 7C, the pressing member 41 is brought into pressure contact with the second tapered surface 42*b*, with the result that the switch shaft 43 moves to a position where the switch shaft 43 is most pressed back against the returning spring 46. At this time, the flag portion 43*f* interrupts the light from the photo interrupter 44 while the switch pressing member 49 turns on the micro switch 45. As a result, both the photo interrupter 44 and the micro switch 45 are turned on.

When both the photo interrupter 44 and the micro switch 45 are in the on state, the control device releases the open indication of the door 30. As a result, the apparatus main body 60A is completely returned to a ready state.

In this case, when shifting from the state of FIG. 7B to the state of FIG. 7C, the switch pressing member 49 in the state of FIG. 7B is pressed back to a position where the flange 50, which is integrally provided to the switch pressing member 49, is abutted against the bearing member 48. Accordingly, even when the switch shaft 43 is pressed back in the direction indicated by the arrow B thereafter, the switch pressing member 49 is stopped at the position where the flange 50 is abutted against the bearing member 48.

It should be noted that, even when the switch pressing member 49 is thus stopped, the switch shaft 43 continues sliding in the same state. For this reason, after that, the remaining sliding displacement amount of the switch shaft 43 which generates until the state of FIG. 7C is obtained is absorbed by the spring 401 for generating a time lag. As a result, the stepped screw 402 slidingly moves in the slit 49*s* and the light from photo interrupter 44 is interrupted by the flag portion 43*f*. With the above-mentioned structure, a time lag can be generated between detection timings of the photo interrupter 44 and the micro switch 45.

On the other hand, in the case where the door 30 is opened, the state of FIG. 7C to the state of FIG. 7A are followed. In other words, when the door 30 is being opened, the pressing member 41 moves toward the first tapered surface 42*a* while being brought into pressure contact with the second tapered surface 42*b*. In association with the movement of the pressing member 41, the switch shaft 43 is pressed back in a direction indicated by the arrow A by the returning spring 46 as illustrated in FIG. 7B.

When the switch shaft 43 is thus pressed back, the interruption of the light by the flag portion 43*f* from the photo interrupter 44 is released and the photo interrupter 44 is turned off. As a result, the control device causes, for example, the display screen (not shown) of the operation portion or the like to display opening of the door 30. At this time, the micro switch 45 remains turned on, and the power supply to the drive portion or the like continues.

Next, when the door 30 is opened, the pressing member 41 is brought into contact with the first tapered surface 42*a* of the pressure contact member 42 as illustrated in FIG. 7A. At this time, the switch shaft 43 moves to the position where the switch shaft 43 is most pressed back by the returning spring 46. In this case, the pressing of the switch lever 45*a* by the switch pressing member 49 is released and the micro switch 45 is turned off, whereby the control device interrupts the power supply to the drive portion or the like.

As described above, when the door 30 is opened, the photo interrupter 44 first detects the opening of the door, and then the micro switch 45 is turned off to interrupt the power supply, thereby generating the time lag. In other words, by slidably mounting the switch pressing member 49 to the switch shaft 43 through the spring 401 for generating a time lag, it is possible to generate the time lag between the detection timings of the photo interrupter 44 and the micro switch 45.

By thus generating the time lag between the detection timings of the photo interrupter 44 and the micro switch 45, it is possible to prevent instantaneous interruption of the power supply after the opening of the door 30 is detected. As a result, as described above, for example, it is possible to prevent a motor driver for performing control of passing a constant current through a drive motor from performing an erroneous control so as to rapidly compensate for the insufficient current due to the instantaneous interruption of the power supply, and prevent, in advance, the motor driver or the drive motor from being damaged or the like.

Thus, the rotational operation of the pressing member 41 which is generated in association with the opening/closing of the door 30 is converted into the sliding movement of the switch shaft 43 through the pressure contact member 42. As a result, it is possible to ensure a sufficient stroke amount for switching on/off of the photo interrupter 44 or the like.

In other words, by sliding the switch shaft 43 by the pressing member 41 which rotates (moves) in association with the opening/closing of the door 30, a sufficient displacement amount can be obtained through the opening/closing operation of the door also in the hinge portion of the door 30 having difficulty in generating the displacement amount. Accordingly, the opening/closing of the door 30 can be detected in association with the sliding of the switch shaft 43, and the power supply can be interrupted.

As a result, even when an additional space is not ensured on a side portion or an upper portion of the door 30, the door opening or closing detecting apparatus 40 can be provided in the space in the vicinity of the hinge portion, which is provided as a dead space such as a retraction space for the door 30, thereby making it possible to achieve space saving and reduction in size of the apparatus.

In this embodiment, the pressure contact member 42 has the tapered surfaces with two different gradients α and β, but the taper surfaces may have multiple gradients which gradually change to a large extent from the opened state of the door 30 to the closed state of the door 30. In this case, increase/decrease of the sliding direction components can be adjusted more finely depending on the change of a reaction of the returning spring 46. Accordingly, a more smooth sliding operation can be realized.

Further, by infinitely increasing the number of gradients, the tapered surface becomes a curved surface at last, and the tip end of the pressing member 41 is brought into contact with curved surfaces, thereby realizing the further smooth sliding operation. In this case, it is assumed that a curvature radius of the curved surface of the pressure contact member 42 is larger than a curvature radius of the tip end of the pressing member 41.

In this embodiment, the electrophotographic color image forming apparatus is described as an example, but any apparatus such as electronic devices having a door can also obtain the effects of the door opening or closing detecting apparatus according to the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-135894, filed May 15, 2006, which is hereby incorporated by reference herein in its entirety.

What is claimed is:

1. An apparatus for detecting an opening or closing of a door comprising:

a housing;

a door rotationally supported by the housing to rotate about an axis of rotation; and a door opening or closing detecting device comprising:

a slidable shaft member mounted to the housing and arranged in parallel with the axis of rotation;

a conversion mechanism which converts a rotation of the door into a sliding of the shaft member in a direction parallel to a rotation axis of the door; and a detecting portion which detects the opening or closing of the door, wherein the detecting portion detects the opening or closing of the door according to sliding of the shaft member by the conversion mechanism in association with the opening or closing of the door.

2. The apparatus according to claim 1, wherein the conversion mechanism comprises:

a pressing member provided for the door and being movable in association with the opening or closing of the door;

a pressure contact portion brought into contact with the pressing member, the pressure contact portion is provided for the shaft member, wherein the shaft member is slid through the intermediary of the pressure contact member by the pressing member, in association with the opening or closing of the door.

3. The apparatus according to claim 2, wherein a tapered surface is formed on a pressure contact surface, with which the pressing member is brought into contact, of the pressure contact portion, and wherein when opening the door, the pressing member is moved along the tapered surface to slide the shaft member.

4. The apparatus according to claim 3, wherein the tapered surface has at least two different gradients with respect to a sliding direction of the shaft member, and wherein angles formed between the gradients and the sliding direction of the shaft member are set in a manner that an angle β of the gradient of the tapered surface with which the pressing member is in contact when the door is closed is larger than an angle α of the gradient of the tapered surface with which the pressing member is in contact when the door is opened, and that the angles α and β of the gradients are each set to be smaller than 90°.

5. The apparatus according to claim 3, wherein the tapered surface is formed of a curved surface.

6. The apparatus according to claim 1, wherein the door has side plates opposing to each other and having one protruding end portions, and wherein a rotation center of the door is provided at the one protruding end portions of the side plates.

7. The apparatus according to claim 1, further comprising a switch portion for interrupting a power supply in association with opening of the door, wherein the detecting portion detects opening or closing of the door according to sliding of the shaft member in association with opening or closing of the door and the switch portion interrupts the power supply.

8. The apparatus according to claim 7, further comprising a switch pressing member for turning on and off the switch portion, wherein the switch pressing member is slidably mounted to the shaft member by providing a spring between the shaft member and the switch pressing member, a time lag is set between detection by the detecting portion and turning on and off of the switching portion, and the power supply is interrupted after opening of the door is detected.

9. The apparatus according to claim 1, wherein the door is rotationally supported by the housing through the intermediary of a hinge member.

10. An image forming apparatus comprising:

an apparatus as recited in claim 1.

* * * * *